US010283094B1

(12) United States Patent
Lidman

(10) Patent No.: US 10,283,094 B1
(45) Date of Patent: May 7, 2019

(54) RUN-LENGTH COMPRESSION AND DECOMPRESSION OF MEDIA TILES

(71) Applicant: Marvell International Ltd., Hamilton (BM)

(72) Inventor: Pontus Lidman, Saratoga, CA (US)

(73) Assignee: Marvell International Ltd., Hamilton (BM)

( * ) Notice: Subject to any disclaimer, the term of this patent is extended or adjusted under 35 U.S.C. 154(b) by 155 days.

(21) Appl. No.: 15/240,902

(22) Filed: Aug. 18, 2016

Related U.S. Application Data

(60) Provisional application No. 62/252,722, filed on Nov. 9, 2015.

(51) Int. Cl.
*G09G 5/395* (2006.01)

(52) U.S. Cl.
CPC ..... *G09G 5/395* (2013.01); *G09G 2340/02* (2013.01); *G09G 2350/00* (2013.01); *G09G 2360/122* (2013.01)

(58) Field of Classification Search
CPC ..... G06F 3/0481; G06F 2203/04806; G06F 3/04845; G06F 3/0485; G06F 3/04855; G09G 5/00; G09G 5/395; G09G 2340/02; G09G 2350/00; G09G 2360/122
See application file for complete search history.

(56) References Cited

U.S. PATENT DOCUMENTS 5,881,176 A * 3/1999 Keith ..... G06F 17/148 375/E7.016
2006/0071825 A1* 4/2006 Demos ..... H03M 7/24 341/50
2016/0277738 A1* 9/2016 Puri ..... H04N 19/61

* cited by examiner

*Primary Examiner* — Abderrahim Merouan

(57) ABSTRACT

A tile-based run-length compression and decompression system is described that reduces memory bandwidth when encoding media data to memory and decoding media data from memory. The described run-length compression system and techniques implement a series of processing steps followed by run-length encoding to compress one or more media frames into a plurality of compressed bits in the form of a run-length encoded bitstream. The described run-length decompression system and techniques implement run-length decoding followed by a series of processing steps to decompress a compressed run-length encoded bitstream into one or more media frames. In various implementations, processing steps applied by run-length compression and decompression systems include one or more of Differential Pulse Code Modulation steps, gray coding steps, bitplane decomposition steps, pixel assembly steps, bitstream extraction steps, or bitplane organization steps. The processing steps, run-length encoding, and run-length decoding techniques discussed herein increase system compression ratios and reduce memory bandwidth usage for a system implementing the techniques when reading media data from, or writing media data to, system memory.

20 Claims, 10 Drawing Sheets

RUN-LENGTH COMPRESSION AND DECOMPRESSION OF MEDIA TILES

RELATED APPLICATIONS

This application claims priority to U.S. Provisional Patent Application Ser. No. 62/252,722 filed Nov. 9, 2015, the disclosure of which is incorporated by reference herein in its entirety.

BACKGROUND

Many different types of memory devices are used to read and write media data for various computers and similar systems. Decoding high resolution media data is a primary memory bandwidth consumer for a System-on-Chip (SoC). In particular, memory bandwidth for SoCs is often the bottleneck that limits expansion of system use. As such, increasing efficiency of memory bandwidth usage for both compression encoders that write media data to memory and compression decoders that read media data from memory is a common target for improving system performance.

Memory bandwidth refers to a rate at which data can be read from or written to (stored in) memory devices, such dynamic random access memory (DRAM) devices, static random memory (SRAM) devices, electrically erasable read only memory (EEPROM), NOR flash memory, NAND flash memory, and so on. Memory bandwidth is commonly expressed in units of bytes per second for systems implementing 8-bit bytes.

Approaches to increasing efficiency of a system's memory bandwidth usage include applying transforms to media data followed by entropy coding the transformed media data. However, these approaches remain inefficient and there is a desire to reduce memory bandwidth used when writing media data to, or reading media data from, system memory.

SUMMARY

This summary is provided to introduce subject matter that is further described below in the Detailed. Description and Drawings. Accordingly, this Summary should not be considered to describe essential features nor used to limit the scope of the claimed subject matter.

A tile-based run-length compression and decompression system is described that reduces memory bandwidth when encoding media data to memory and decoding media data from memory. As discussed herein, "media data" refers to video data, image data, graphics data, or combinations thereof. The described system employs various pre-processing modules and a run-length coding module for compressing frames of media data to compressed bits that reduce memory bandwidth when the media data is written to memory. Pre-processing modules include a Differential Pulse Code Modulation (DPCM) module, a gray coding module, a bitplane decomposition module, and a bitstream extractor module, which are configured to prepare media data frames for run-length encoding. Similarly, the described system employs a run-length decoding module and various post-processing modules for decompressing compressed bits of media data from memory into media data frames in a manner that reduces memory bandwidth when the media data is read from memory. Post-processing modules include a bitplane organizer module, a pixel assembly module, an inverse gray coding module, and a reverse DPCM module, which are configured to construct media data frames from compressed media data bits that have been decoded by the run-length decoding module.

BRIEF DESCRIPTION OF THE DRAWINGS

The details of one or more implementations are set forth in the accompanying figures and the detailed description below. In the figures, the left-most digit of a reference number identifies the figure in which the reference number first appears. The use of the same reference numbers in different instances in the description and the figures indicate like elements.

DETAILED DESCRIPTION

This disclosure describes apparatuses and techniques for run-length compression and decompression of media content that reduce memory bandwidth usage for the system in which they are incorporated when reading media content from or writing media content to memory. The described run-length compression system and techniques implement a series of processing steps followed by run-length encoding to compress one or more media frames into a plurality of compressed bits in the form of a run-length encoded bitstream. The described run-length decompression system and techniques implement run-length decoding followed by a series of processing steps to decompress a compressed run-length encoded bitstream into one or more media frames. The described run-length compression and decompression systems can be used to compress media content from embedded SoC memory to external memory and/or vice versa. In various implementations, processing steps applied by run-length compression and decompression systems include one or more of DPCM steps, gray coding steps, bitplane decomposition steps, pixel assembly steps, bitstream extraction steps, or bitplane organization steps. The processing steps, run-length encoding, and run-length decoding techniques discussed herein increase system compression ratios and reduce memory bandwidth usage for a system implementing the techniques when reading media data from, or writing media data to, system memory. The described run-length compression and decompression systems can be used to compress and decompress entire pieces of media content, or portions thereof. For example, in a scenario where only a subset of a plurality of frames of a piece of media content need to be edited, played back, and so on, the described run-length compression and decompression systems can be used to compress and/or decompress only the subset of the plurality of frames. By only compressing and/or decompressing a subset of media content, the processing steps, run-length encoding, and run-length decoding techniques discussed herein further increase system compression ratios and reduce memory bandwidth usage when reading media data from, or writing media data to, system memory.

Figure 1:
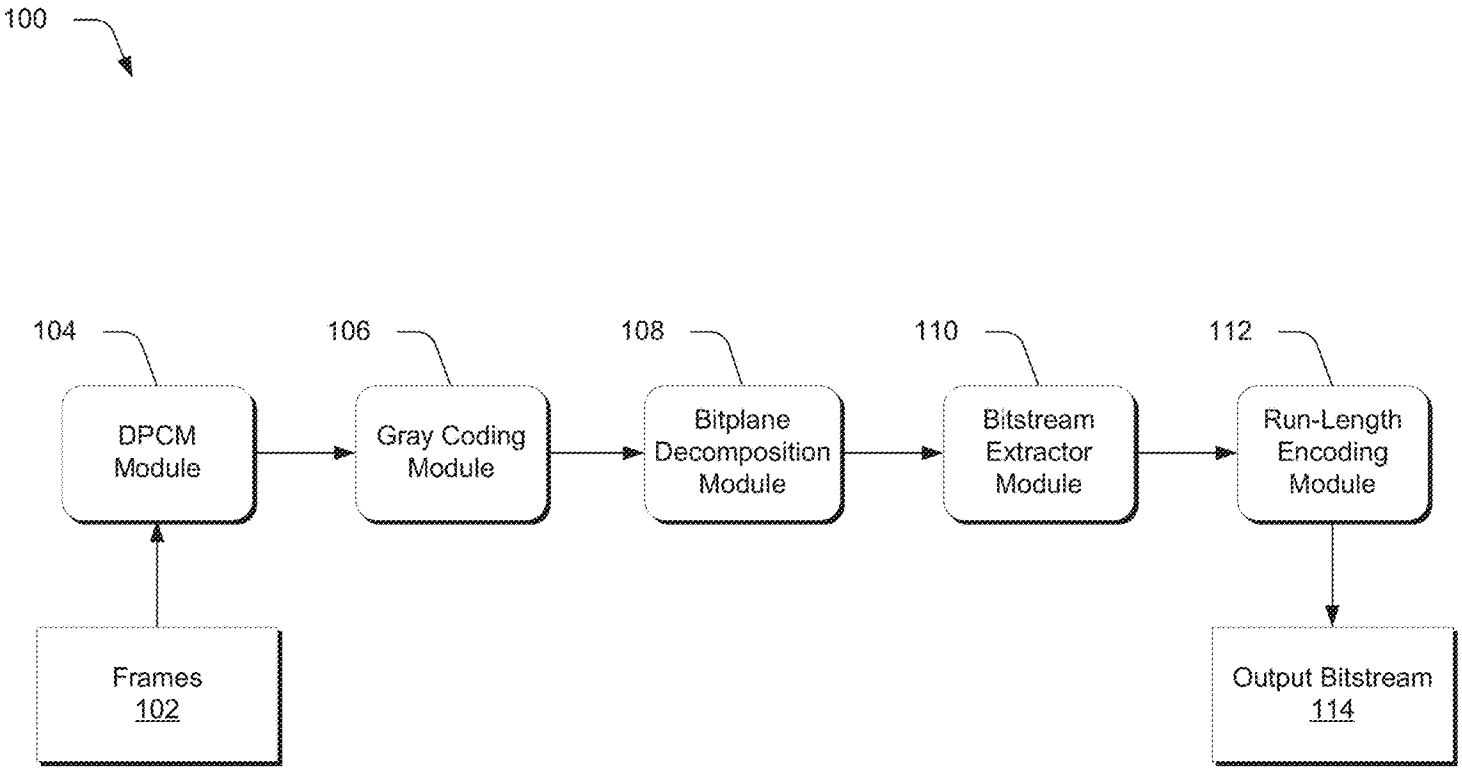
FIG. 1 illustrates an example run-length media compression system in accordance with one or more embodiments.

FIG. 1 illustrates an example run-length media compression system in accordance with one or more embodiments generally at 100. System 100 is configured to process media content frames 102 into an output bitstream 114 and includes, in the illustrated example, a DPCM module 104, a gray coding module 106, a bitplane decomposition module 108, a bitstream extractor module 110, and a run-length coding module 112. Although discussed herein in the context of frames 102, media content frames 102 are representative of any type of video data or graphics data. In this manner, system 100 is configured to compress pixel values of media content frames 102 into a contiguous sequence of bits, represented by output bitstream 114.

DPCM module 104 is configured to receive one or more media content frames 102 that are to be compressed and written to memory. DPCM module 104 is configured to organize the one or more media content frames 102 into one or more tiles. As discussed herein, a tile represents a local region of media content. For example, DPCM module 104 may organize a single frame of the one or more media content frames 102 into a plurality of tiles. A tile size of an individual tile is measured in terms of pixels of media content. For example, in accordance with one or more embodiments, DPCM module 104 is configured to organize media content frames 102 into individual tiles that are each sized 64 pixels×4 pixels. However, any suitable tile shape and tile size can be used. By organizing media content frames 102 into individual tiles, DPCM module 104 improves data locality when compressing the media content. For example, access to memory is fastest when accessed addresses are sequential within one memory page. By organizing media content frames 102 into tiles, DPCM module 104 creates a local region of a media content frame, in two dimensions, that corresponds to a linear sequence of addresses in memory, thereby enabling fast access to a local media content region stored in memory. Although discussed herein as being performed by DPCM module 104, organizing media content frames 102 into tiles may be performed before the media content frames are received by the DPCM module 104, such as by a computing device implementing the run-length media compression system 100.

After media content frames have been organized into tiles, DPCM module 104 is configured to reduce magnitudes of pixel values in the individual tiles using DPCM, To accomplish this, DPCM module 104 selects a hard-coded starting value as a first previous value. For example, the hard-coded starting value may be a pixel value representing an average color, such as a mid-gray. Alternatively, the hard-coded starting value may be a pixel value representing black. In accordance with one or more embodiments where pixel color values for a tile are known, the hard-coded starting value may be a pixel value representing the most frequent color in the tile or a pixel value representing the average color of the tile. DPCM module 104 then loops through each pixel in a tile. During the loop, the DPCM module 104 replaces an individual pixel's value with the difference between the current value of the individual pixel and the value of the previous pixel. If the individual pixel is the first pixel in the tile, DPCM module 104 selects the hard-coded starting value as the previous pixel value. By applying DPCM to individual pixels of each tile, DPCM module 104 reduces entropy in higher-order pixel bits. The DPCM module 104 may process all tiles or only some tiles. After the DPCM module 104 processes the tiles, run-length media compression system 100 gray codes each tile processed by DPCM module 104 using gray coding module 106.

Gray coding module 106 is representative of functionality that applies gray coding to each pixel in a tile, which reduces hamming distances between different pixel values for a tile. The hamming distance between two pixels refers to a difference between binary values of the two pixels. By processing individual tiles using gray coding, gray coding module 106 reduces bad or undesirable compression spots near certain value boundaries. For example, bad or undesirable compression spots may occur when there is a small variation between two pixel values but there is a large number of bit flips, such as the variation between hexadecimal values 0x7f and 0x80. 0x7f corresponds to 127 when expressed in decimal format and 1111111 when expressed in binary format. Conversely, 0x80 corresponds to 128 when expressed in decimal format and 10000000 when expressed in binary format. Thus, although there is a small decimal variation between the two pixel values, there is a significant number of bit flips, which creates a bad or undesirable compression spot.

In accordance with one or more embodiments, gray coding module 106 is configured to reduce the hamming distance between two pixel values using Binary Reflected Gray Code, represented by the following C code:

```
uint16_t gray(uint16_t n)
{
  return n^(n>>1);
}
```

The above code is merely illustrative, and gray coding module 106 can be configured to perform gray coding using a variety of approaches. Gray coding module 106 performs gray coding for each pixel of each tile generated from the media content frames 102. After each tile has been gray coded, nm-length media compression system 100 decomposes bits of each tile into bitplanes using the bitplane decomposition module 108.

Bitplane decomposition module 108 is representative of functionality that separates bits of tile pixel values into bitplanes. As discussed herein, an individual bitplane represents a bit integer value for a specific bit integer position for each pixel in a tile. Functionality of bitplane decomposition module 108 is discussed in further detail below with respect to FIGS. 3 and 4. After the pixels of each tile have been decomposed into a plurality of bitplanes, run-length media compression system 100 extracts a bitstream from the plurality of bitplanes using bitstream extractor module 110.

Bitstream extractor module 110 is representative of functionality that converts two-dimensional bitplanes into a one-dimensional bitstream. Bitstream extractor module 110 converts two-dimensional bitplanes into a one-dimensional bitstream by extracting bitplane pixel values from each bitplane. The order and method M which bitstream extractor module 110 extracts bitplane pixel values can vary in accordance with one or more embodiments. Functionality of bitstream extractor module 110 is discussed in further detail below with respect to FIG. 5. After the two-dimensional bitplanes are converted into a one-dimensional bitstream, run-length media compression system 100 applies run-length encoding to the one-dimensional bitstream using run-length encoding module 112.

Run-length encoding module 112 is representative of functionality that identifies runs of identical bits in a bitstream that are longer than or equal to a given minimum length of bits and generates an output bitstream that does not contain the runs of identical bits. As discussed herein, a run of identical bits may also be referred to as a repeat run. Functionality of run-length encoding module 112 is discussed in further detail below with respect to FIG. 6. By generating output bitstream 114 that does not contain runs of identical bits, via run-length encoding module 112, run-length media compression system 100 performs lossless compression of media data in a manner that reduces memory bandwidth usage when the media data is written to memory.

Figure 2:
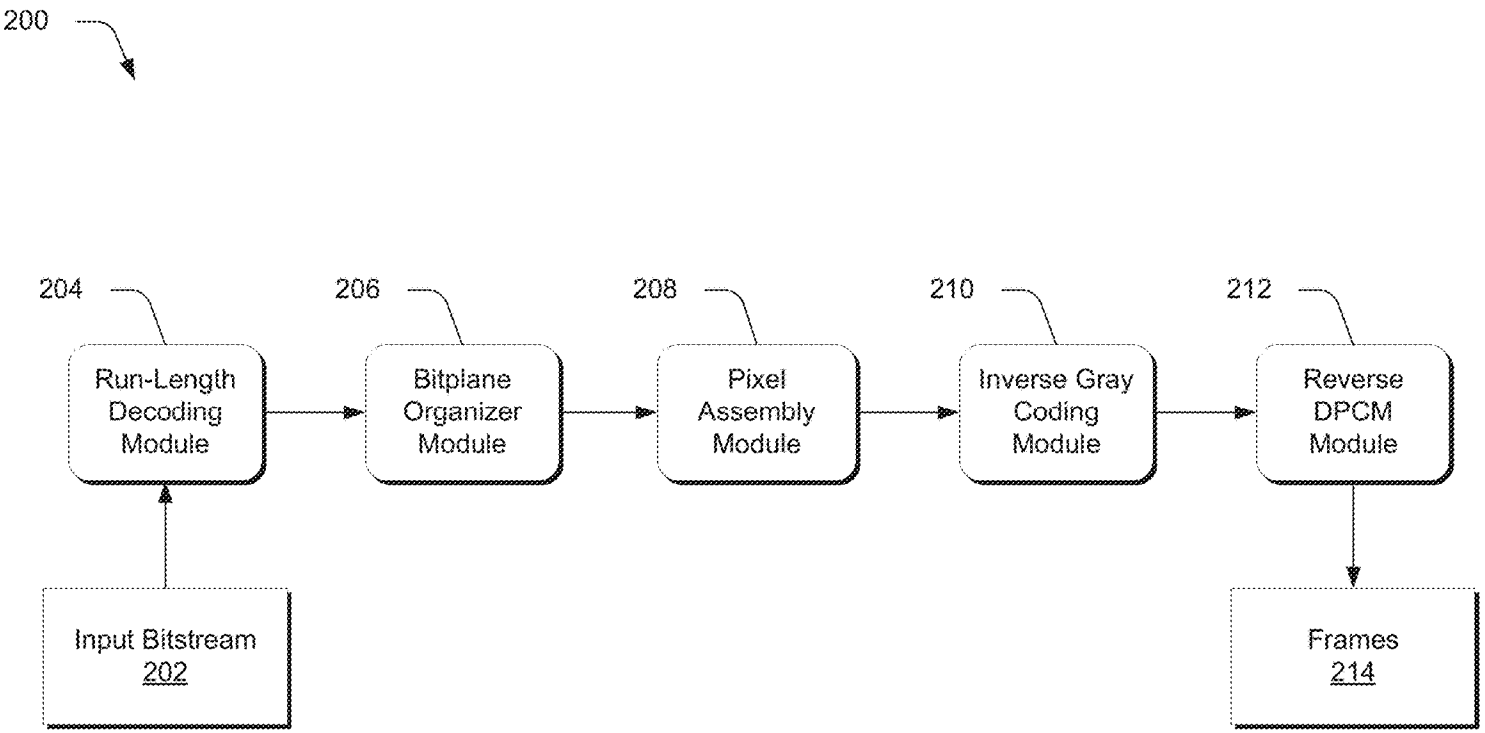
FIG. 2 illustrates an example run-length media decompression system in accordance with one or more embodiments.

FIG. 2 illustrates an example run-length media decompression system in accordance with one or more embodiments generally at 200. System 200 is configured to process an input bitstream 202 and includes, in the illustrated example, a run-length decoding module 204, a bitplane organizer module 206, a pixel assembly module 208, an inverse gray coding module 210, and a reverse DPCM module 212.

Run-length decoding module 204 is representative of functionality that receives (i.e., reads) compressed media content bits of the input bitstream 202 from memory and decompresses the received media content bits. Run-length decoding module 204 decompresses media content bits by performing the reverse operations of run-length encoding module 112 illustrated in FIG. 1, which are discussed herein. Accordingly, although illustrated as a separate module that is implemented in a different system, module 112 may be configured to perform functionality of run-length decoding module 204 and/or vice versa. After run-length decoding module 204 decompresses media content bits of the input bitstream 202, run-length media decompression system 200 passes the decompressed media content data in the form of a bitstream to bitplane organizer module 206. Bitplane organizer module 206 processes the received media content data and passes it to pixel assembly module 208. Pixel assembly module 208 processes the received media content data and passes it to inverse gray coding module 210, which processes and passes the media content data to reverse DPCM module 212 for post-processing the decompressed media bits into media content frames 214.

Bitplane organizer module 206 is representative of functionality that converts a one-dimensional bitstream into two-dimensional bitplanes. Using a similar order and method to an order and method that was used to generate the one-dimensional bitstream, bitplane organizer module 206 sequentially extracts bitstream values to create corresponding bitplanes for media content associated with the decompressed media bits. Thus, bitplane organizer module 206 is configured to perform the reverse operations of bitstream extractor module 110 illustrated in FIG. 1, which are discussed herein. Accordingly, although illustrated as a separate module that is implemented in a different system, functionality of bitplane organizer module 206 may also be performed by bitstream extractor module 110. After bitplane organizer module 206 generates the two-dimensional bitplanes, run-length media decompression system 200 passes the two-dimensional bitplanes to pixel assembly module 208.

Pixel assembly module 208 is representative of functionality that extracts bitplane values to create tiles that each include pixels. Pixel assembly module 208 generates a pixel value for each pixel in a tile by combining a bit value from a location corresponding to the pixel from each of bitplane. Recall that each bitplane represents a bit integer position, thus enabling pixel assembly module 208 to generate the proper pixel value for a pixel using each of the bitplanes. Pixel assembly module 208 generates a pixel value for each pixel in a tile by performing the reverse operations of bitplane decomposition module 108 illustrated in FIG. 1, which are discussed herein. Accordingly, although illustrated as a separate module that is implemented in a different system, functionality of pixel assembly module 208 may be performed by bitplane decomposition module 108. After pixel assembly module 208 creates one or more tiles from the plurality of bitplanes, run-length media decompression system 200 passes the one or more tiles to inverse gray coding module 210.

Inverse gray coding module 210 is representative of functionality that recovers original pixel values from the gray-coded pixel values of the one or more tiles received from pixel assembly module 208. In accordance with one or more embodiments, inverse gray coding module 210 restores a hamming distance between two pixel values in a tile using the following C code:

```
uint16_t inverse_gray(uint16_t n)
{
  n^=n>>8;
  n^=n>>4;
  n^=n>>2;
  n^=n>>1;
  return n;
}
```

The above code is merely illustrative and the inverse gray coding module 210 can perform inverse gray coding using any suitable inverse gray coding approach. Although illustrated as a separate module that is implemented in a different system, functionality of inverse gray coding module 2:1.0 may be performed by gray coding module 106 illustrated in FIG. 1. After one or more tiles associated with media content has been inverse gray coded, run-length media decompression system 200 applies reverse DPCM to the tiles and generates media content frames 214.

Reverse DPCM module 212 is representative of functionality that generates media content frames 214 from tiles associated with media content. Reverse DPCM module 212 increases of pixel value magnitudes in tiles to an original pixel value magnitude for each pixel. Reverse DPCM module 212 restores original pixel value magnitudes for pixels in a tile by performing the reverse operations of DPCM module 104 illustrated in FIG. 1, which are discussed herein. Accordingly, although illustrated as a separate module that is implemented in a different system, functionality of reverse DPCM module 212 may be performed by DPCM module 104. The media content frames 214 can then be consumed by a media engine of a computing device. In this manner, run-length media decompression system 200 performs lossless media decompression while reducing memory bandwidth usage when media data is read from memory.

Figure 3:
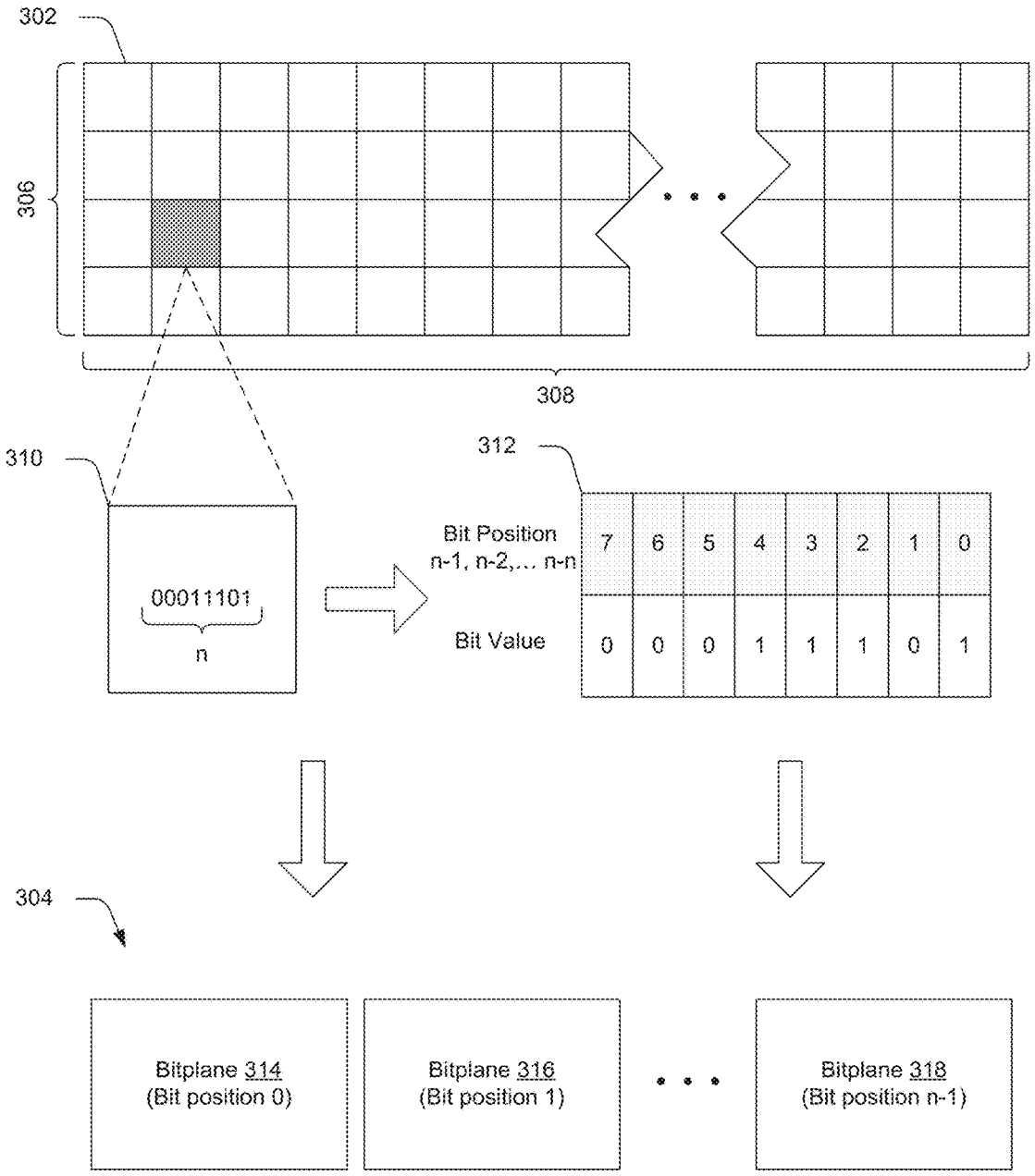
FIG. 3 illustrates an example media tile decomposed into bitplanes in accordance with one or more embodiments.

FIG. 3 illustrates an example media tile 302 decomposed into bitplanes 304 in accordance with one or more embodiments. In this example, media tile 302 corresponds to an area of visible pixels of media content. Media tile 302 is illustrated as including a plurality of pixel rows 306 and a plurality of pixel columns 308. In accordance with one or more embodiments, media tile 302 is sized as a 64 pixel×4 pixel tile, which includes 64 pixel columns and 4 pixel rows. By organizing media content frames into 64 pixel×4 pixel tiles, the techniques described herein reduce a number of 64-byte bursts when reading media data from memory or writing media data to memory. The 6.4 pixel×4 pixel media tile is merely illustrative and that media content frames can be organized into any suitable tile size.

Each pixel in a media tile includes a pixel value having a length of n bits. The number of different colors in the media content depends on the media content's depth of color, which is represented by bits per pixel. For example, pixel 310 is illustrated as including 8 bits, which indicates that the media content represented by media tile 302 is of an 8-bit per pixel format. Thus, if the media content represented by media tile 302 was configured in a 10-bit per pixel format, pixel 310 would include a pixel value having a length of 10 bits.

Table 312 illustrates how pixel bit values are decomposed into n bitplanes for n bit positions. Using the illustrated example media tile 302, the media content represented by media tile 302 is of an 8-bit format, which results in decomposing media tile 302 into eight different bitplanes. As discussed herein, a bitplane is a set of bits, corresponding to a given bit position in a binary number representing a pixel value, for each pixel in a media tile. Individual bitplanes are created for each bit position in a pixel value. Accordingly, a bitplane can be illustrated as an array including rows of bits 306 and columns of bits 308 corresponding to a single bit position for a binary number representing a pixel value.

For example, a bit value in the $0^{th}$ bit position (i.e., n−n) for each pixel value in media tile 302 is extracted and decomposed into bitplane 314, illustrated generally at 304. Similarly, a bit value in the $1^{st}$ bit position for each pixel in media tile 302 is extracted and decomposed into bitplane 316. This decomposition is performed for each bit position until the final bit position n−1 is extracted and decomposed into bitplane 318. In accordance with one or more embodiments, decomposing pixel values into individual bitplanes is performed by bitplane decomposition module 108, illustrated in FIG. 1.

Figure 4:
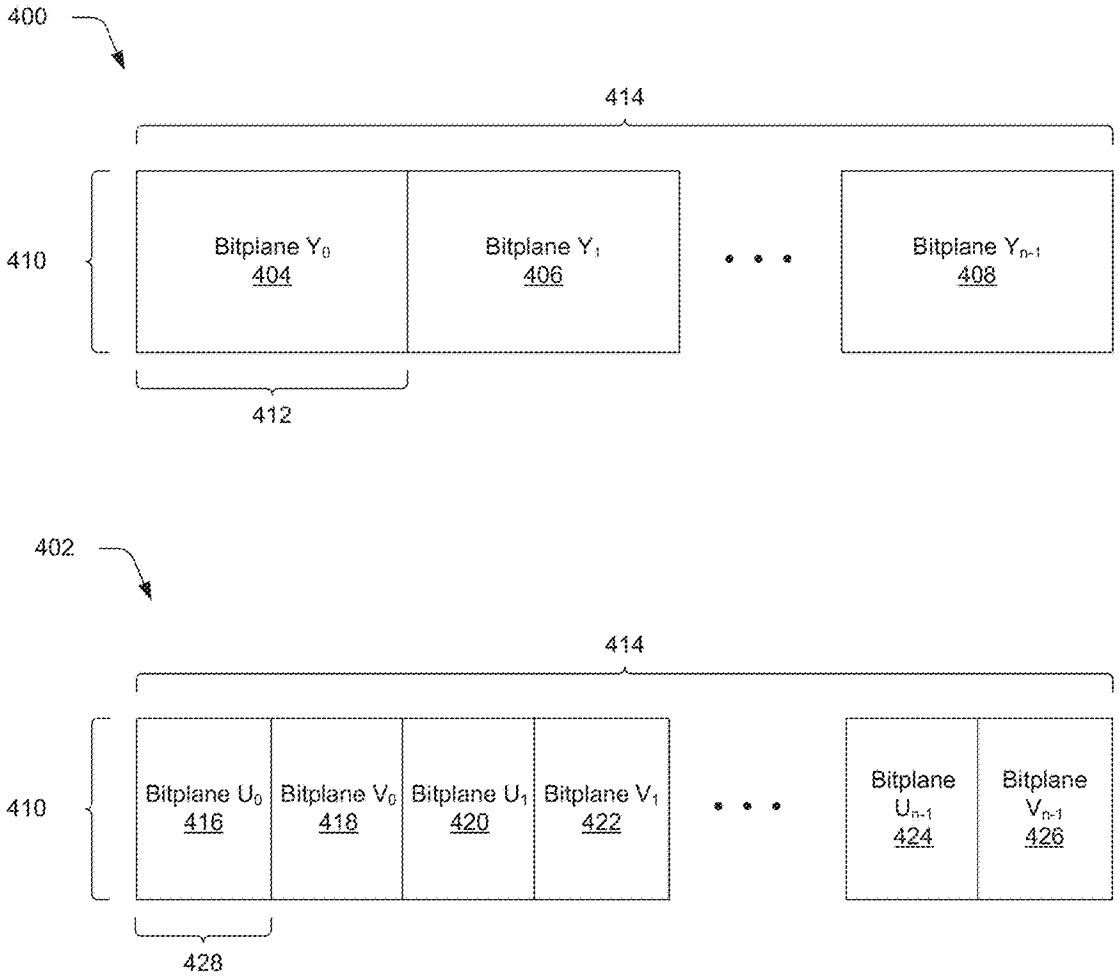
FIG. 4 illustrates example media bitplanes in accordance with one or more embodiments.

FIG. 4 illustrates example media bitplanes generally at 400 and 402 in accordance with one or more embodiments. Using the techniques discussed herein, media bitplanes may be constructed by bitplane decomposition module 108, as illustrated in FIG. 1. In the illustrated examples, media bitplanes are constructed for Y, U, and V values in a media tile, such as media tile 304 illustrated in FIG. 3. YUV refers to a color space where a Y pixel value describes the luminance (i.e., pure intensity) of an individual pixel. U and V pixel values describe the chrominance of an individual pixel. As such, the example media bitplanes illustrated at 400 represent example luminance bitplanes for media content and the example media bitplanes illustrated at 402 represent example chrominance bitplanes for media content.

Size and amount values of the luminance and chrominance bitplanes for media content depend on both a media tile size and a data format of the media content. As discussed above, the number of bits per pixel determines a number of bitplanes that will be generated from a media tile. For example, assume that media content is formatted as 4:2:0 8-bit video pixel format and that frames of the media content are organized into 64 pixel×4 pixel tiles, such as media tile 304 illustrated in FIG. 3. The Y input of one media tile is 64 pixel×4 pixel tiles, with each pixel including a luminance sample value for a corresponding tile pixel. The U and V input of one media tile are 64 pixel×4 pixel tiles, corresponding to 32 pixel×4 pixel samples from each component U and V. In this manner, the U and V components are combined into a single tile, which will then have the same size in bytes as a Y tile. As evidenced by the illustrated example 402, fewer samples of chrominance values U and V are used in constructing chrominance bitplanes to account for human perception. The human eye has less spatial sensitivity to color than spatial sensitivity to brightness. Accordingly, including fewer chrominance samples will reduce memory bandwidth usage during compression and decompression with a negligible effect on human perception of the media content.

Each Y bitplane includes a plurality of bit rows 410 and a plurality of bit columns 412. A number of bit rows 410 is equivalent to a number of pixel rows in a media tile, such as pixel rows 306 in media tile 304, as illustrated in FIG. 3. Similarly, a number of bits in bit columns 412 is equivalent to a number of pixel columns in a media tile, such as pixel columns 308 in media tile 304, as illustrated in FIG. 3.

Using the bitplane decomposition techniques described herein, a plurality of luminance bitplanes 404, 406 . . . 408 illustrated at 402 are stored in a two-dimensional region spanning bit rows 410 by bit columns 414. Because a number of bitplanes generated from a media tile is dependent on a number of bits per pixel in associated media content, a resulting number of bit columns 414 in the two-dimensional region is equivalent to a number of media tile columns, such as media tile columns 308 illustrated in FIG. 3, multiplied by a number of bits per pixel for the media content. For example, assuming that media content is of an 8-bit format and organized into 64 pixel×4 pixel tiles, the resulting luminance bitplanes would span 4 bit rows by 512 bit columns. If media content is of a 10-bit format and organized into 64 pixel×4 pixel tiles, the resulting luminance bitplanes would span 4 bit rows by 640 bit columns.

Continuing to the plurality of chrominance bitplanes illustrated at 402, each U bitplane includes a plurality of bit rows 410 and a plurality of bit columns 428. A number of bit rows 410 is equivalent to a number of pixel rows in a media tile constructed from media content, such as pixel rows 306 in media tile 304, as illustrated M FIG. 3. A number of bit columns 428 is equivalent to half a number of pixel columns in a media tile constructed from media content, such as pixel columns 308 in media tile 304, as illustrated in FIG. 3.

Using the bitplane decomposition techniques described herein, a plurality of chrominance bitplanes 416, 418, 420, 422 . . . 424, and 426 are organized in a two-dimensional region spanning bit rows 410 by bit columns 414. As illustrated at 402, chrominance U and V bitplanes for a media tile are stored sequentially corresponding to a bit position for the bitplane. Although U bitplanes 416, 420, and 424 are illustrated as preceding corresponding V bitplanes 418, 422, and 426, respectively, V bitplanes 418, 422, and 426 may be stored as preceding U bitplanes 416, 420, and 424 in the two-dimensional region illustrated at 402 in accordance with one or more embodiments. The resulting number of bit columns 414 will be the same as the number of bit columns generated for the Y bitplane and is equivalent to a number of media tile columns multiplied by a number of bits per pixel of the media content. For example, assuming that media content is of an 8-bit format and organized into 64 pixel×4 pixel tiles, a resulting plurality of chrominance bitplanes would span 4 bit rows by 512 bit columns. If media content is of a 10-bit format and organized into 64 pixel×4 pixel tiles, a resulting plurality of chrominance bitplanes would span 4 bit rows by 640 bit columns.

Although the example bitplanes of FIG. 4 are discussed as being generated from YUV 4:2:0 8-bit and YUV 4:2:0 10-bit media content formats, it is to be appreciated and understood that the techniques described herein are configured to generate media bitplanes from various other media content formats, such as ARGB formats, packed YUV 4:2:2 formats, and so on.

Figure 5:
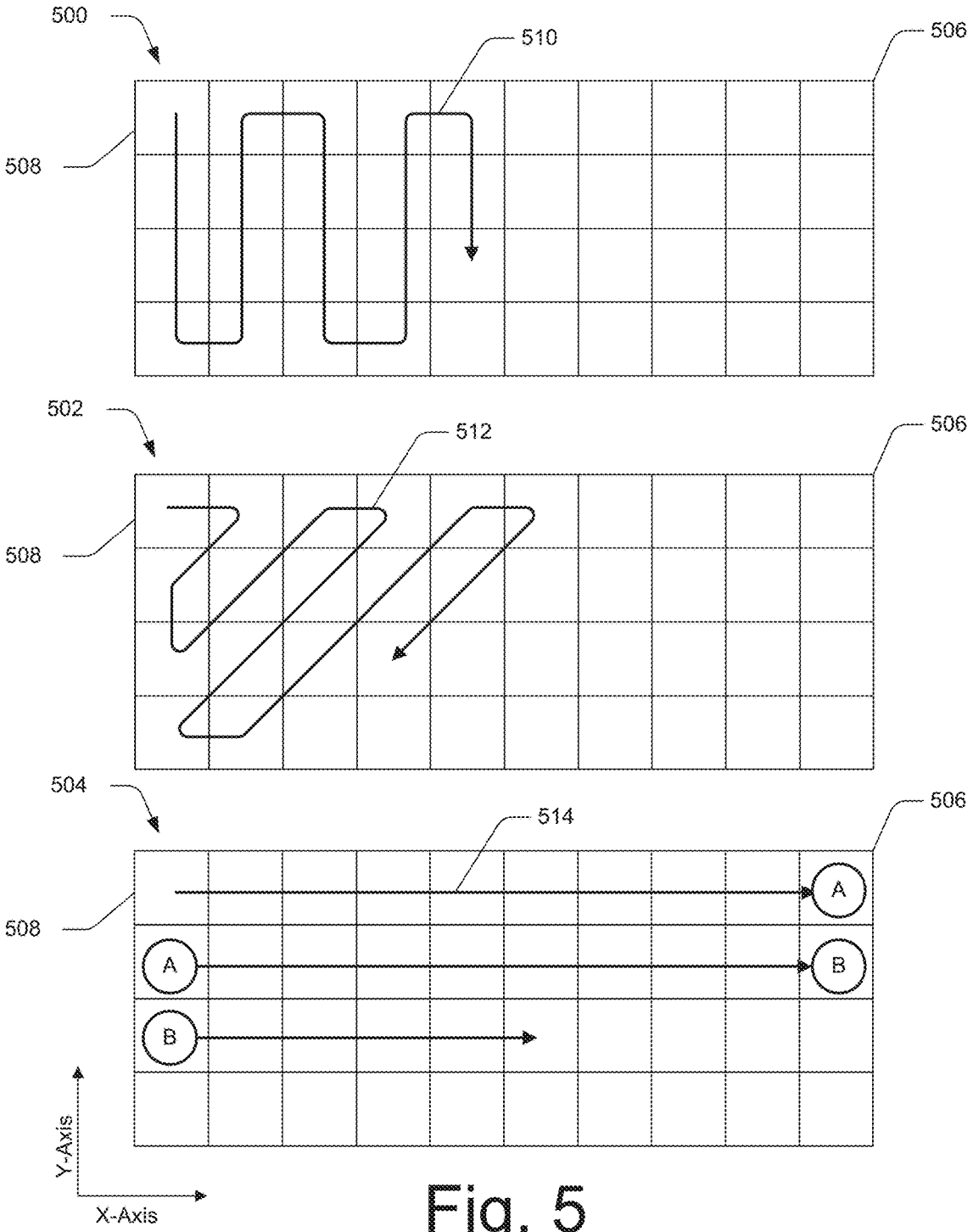
FIG. 5 illustrates example approaches for extracting a linear bitstream from bitplanes in accordance with one or more embodiments.

FIG. 5 illustrates an example of extracting a linear bitstream from a two-dimensional region of bitplanes, which are generally discussed at 500, 502, and 504. Using techniques discussed herein, a linear bitstream is extracted from a two-dimensional region of bitplanes, comprising a two-dimensional array of bit values, by bitstream extractor module 110, as illustrated in FIG. 1.

In the illustrated example 500 of FIG. 5, a two-dimensional region of bitplanes 506 includes an array of bit values represented by boxes of the two-dimensional region of bitplanes 506, such as box 508. A one-dimensional bitstream is created by sequentially extracting bit values from each box of the two-dimensional region of bitplanes 506 and sequentially inserting the bit values into the linear bitstream. For example, path 510 illustrated in example begins by extracting a bit value from the two-dimensional region of bitplanes 506 corresponding to the position illustrated by box 508. The path 510 proceeds down the Y-Axis until the end of the region of bitplanes 506 is reached. The path 510 then proceeds to the right along the X-Axis and continues in a serpentine pattern until all bit values from the region of bitplanes 506 have been compiled into a linear bitstream. Path 510 is advantageous when compressing media content that includes similar vertical features, as the extracted bit values from the region of bitplanes 506 will produce long runs of identical bits. A discussion of how runs of identical bits affect compression and decompression of media data is included below with respect to FIG. 6. For media content that includes similar horizontal features, path 512 illustrated in example 502 is advantageous for compression and decompression, as the zig-zag pattern of path 512 will produce long runs of identical bits corresponding to similar horizontal features in media content.

A linear bitstream can be created from a two-dimensional region of bitplanes 506 using any path and that paths 510 and 512 are merely illustrative examples. For example, bit values may be extracted from a region of bitplanes 506 into a linear bitstream following path 514 illustrated in example 504. In the example 504, callouts "A" and "B" represent transitions between various boxes in the continuous progression of path 514. For example, path 514 begins at block 508 and proceeds to the right along the X-Axis until reaching callout A of the same row as block 508, then proceeds without interruption to the block below block 508 in the Y-Axis, represented by the callout A below block 508. Similarly, callout B represents a transition between blocks in the progression of path 514. The size of compressed media content will vary based on visual features included in uncompressed media content and the corresponding path used to generate a linear bitstream from a two-dimensional region of bitplanes that were decomposed from the media content.

Figure 6:
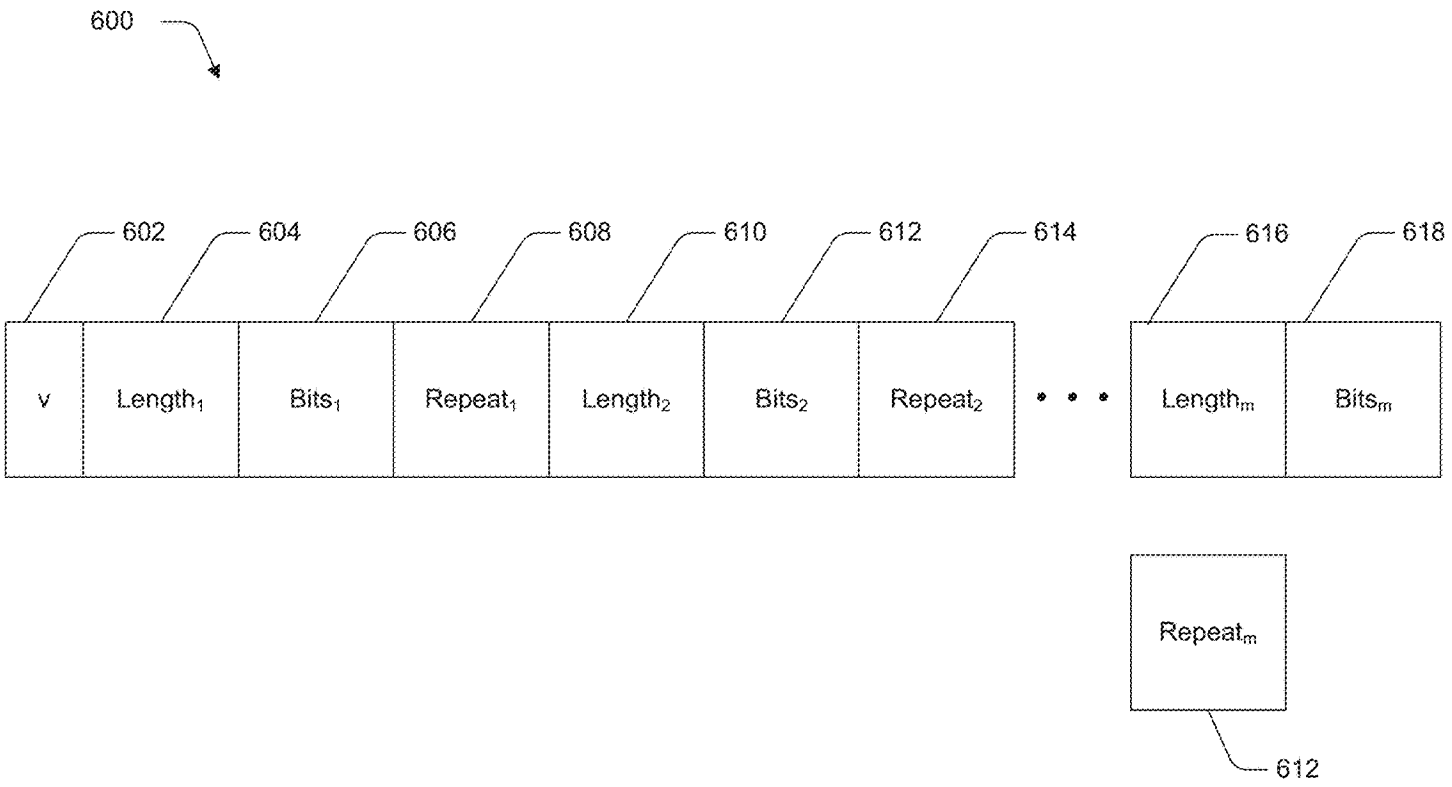
FIG. 6 illustrates an example sequence of run-length encoded bits in accordance with one or more embodiments.

FIG. 6 illustrates an example run-length encoded linear bitstream generally at 600 in accordance with one or more embodiments. Using techniques discussed herein, the run-length encoded linear bitstream illustrated at 600 can be created by run-length encoding module 112, as illustrated in FIG. 1.

In accordance with one or more embodiments, a nm-length encoded bitstream is constructed from a linear bitstream by identifying runs of identical bits (i.e., repeat runs) that are longer than or equal to a minimum run length. The run-length encoded bitstream does not contain these repeat runs, thereby reducing memory bandwidth overhead when writing the run-length encoded bitstream to memory or reading the run-length encoded bitstream from memory.

An encoder that outputs the run-length encoded bitstream, such as run-length encoding module 112 illustrated in FIG. 1, operates under two parameters. The first parameter defines a minimum run length for identical bits, and may be identified as "MIN_REPEAT" in accordance with one or more embodiments. For example, in one or more embodiments MIN_REPEAT is selected to be 11 bits. The second parameter is the Exp-Goiomb order, expressed as "k" to use for representing bit length fields. Stated differently, the length fields of a run-length encoded bitstream are encoded using $kt^h$ order Exp-Golomb coding. In accordance with one or more embodiments, k is selected to be 3. Alternatively, the length fields of a run-length encoded bitstream are encoded using a static Huffman table in accordance with one or more embodiments.

A run-length encoded bitstream is given a single bit initial value "v", illustrated at portion 602 in the example run-length encoded bitstream at 600. The initial value v as discussed herein represents the inverse of a first lit of an input linear bitstream from which the run-length encoded bitstream is constructed. The initial value v is then followed by one or more literal runs and one or more repeat runs of bits. As discussed herein, a literal run of bits identifies bits that are copied from an input bitstream to an output bitstream during decoding. A length of the literal run of bits is identified by $length_m$ and the contents of the literal run are identified by $bits_m$. A repeat run of bits means that constant bits are inserted into an output bitstream and a length of a repeat run is identified by $repeat_m$.

The bit value to be included for bits in a repeat run during decoding is defined as the inverted value of the last bit produced. For example, if a repeat run follows a last bit produced having a value of "1", the repeat run would insert a designated length of "0" value bits. If the first run following the initial value of a run-length encoded bitstream is a repeat run, the initial value v is used as the last bit produced. The length of a repeat run, by definition, must be greater than or equal to MIN_REPEAT. Accordingly, the value $repeat_m$, indicating the length of a repeat run, identifies the number of bits minus MIN_REPEAT in accordance with one or more embodiments.

In one or more embodiments, the length of a literal run can be zero. In this case, there are no bits included in the contents of the literal nm identified by $bits_m$. A literal run having zero length can occur if the first run following the initial value v is a repeat run, where a zero length literal run is inserted to preserve output format during decoding. Additionally or alternatively, a literal run having zero length can occur if a first repeat run is adjacent to a second repeat run, where the values of the first and second repeat runs are inverse from one another, Inserting a zero-length literal run for adjacent inverse repeat runs similarly preserves the output format of the nm-length encoded bitstream during decoding.

For example, in the example run-length encoded bitstream illustrated at 600, portion 604 identifies a first length of bits that are to be copied literally from the run-length encoded bitstream during decoding and portion 606 identifies the bit values spanning the first length that are to be copied literally during decoding. Portion 608 identifies a length of repeat bits that are to be inserted into a run-length bitstream during decoding. Similarly, portion 610 identifies a second length of bits that are to be copied literally from the run-length encoded bitstream during decoding and portion 612 identifies the bit values spanning the second length that are to be copied literally during decoding. Portion 614 identifies a length of repeat bits that are to be inserted into a run-length bitstream during decoding. The run-length encoded bitstream either may end with a literal run, illustrated as portions 616 and 618, or may end with a repeat run, illustrated as portion 612.

By replacing repeat runs of an input bitstream, a run-length encoded bitstream generated using the techniques described herein will be shorter than a length of the input bitstream. This decreased bitstream length reduces memory bandwidth usage, thereby increasing system performance when reading media data from, or writing media data to, memory.

Figure 7:
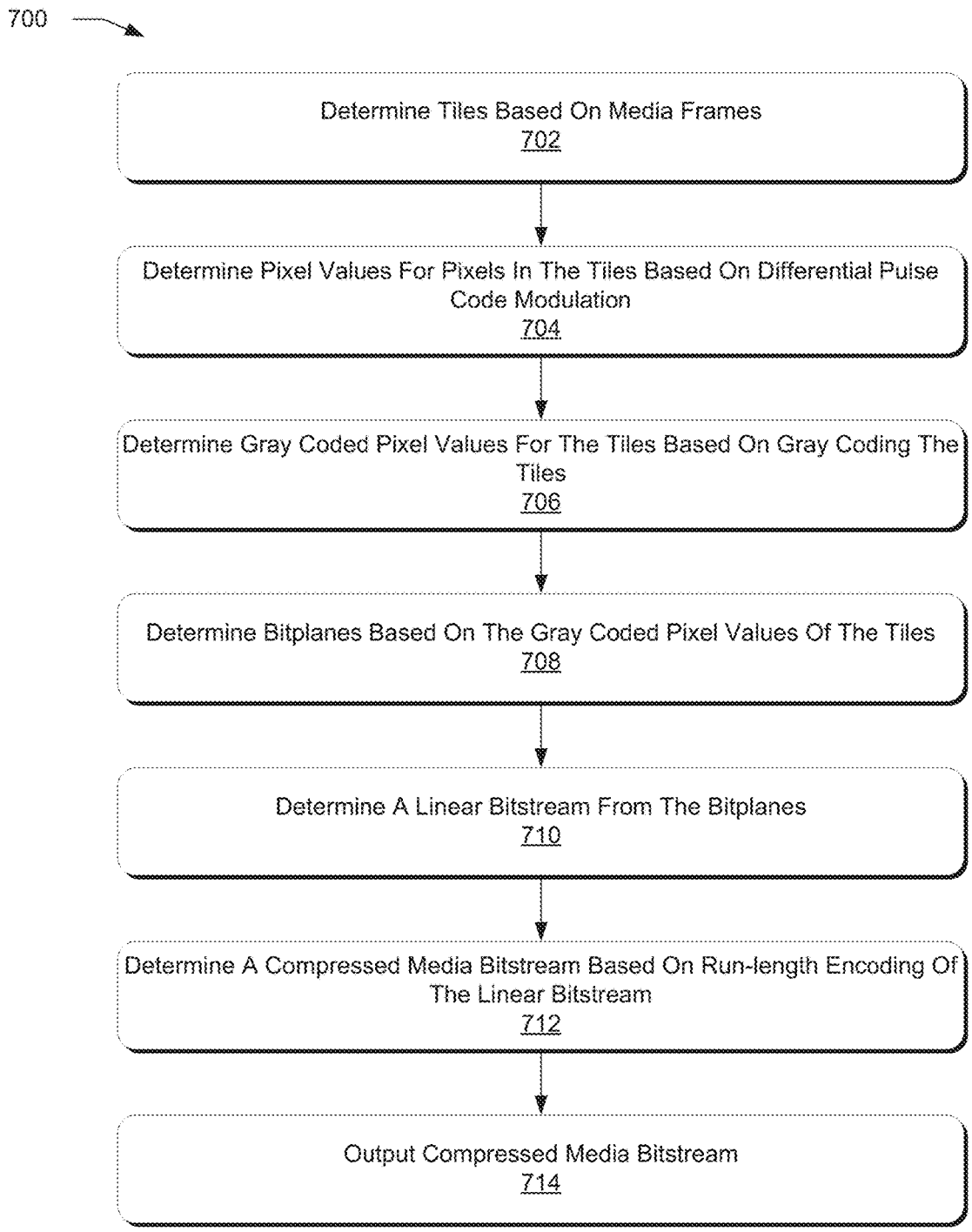
FIG. 7 is a flow diagram that describes steps in a method in accordance with one or more embodiments.

FIG. 7 illustrates a flow diagram that describes steps in a compression method 700 in accordance with one or more embodiments. The method can be implemented in connection with any suitable hardware, software, firmware, or combination thereof. In the illustrated and described embodiment, the method 700 can be implemented by a suitably-configured run-length media compression system, such as nm-length media compression system 100 as illustrated in FIG. 1.

At 702, one or more tiles are determined based on one or more media frames. In at least some embodiments, one or more media frames are organized into tiles spanning 64 pixels by 4 pixels. At 704, pixel values for pixels in the one or more tiles are determined based on differential pulse code modulation (DPCM). At 706, gray coded pixel values are determined for the tiles based on gray coding the DPCM processed tiles. At 708, a plurality of bitplanes are determined based on the gray coded pixel values of the one or more tiles. A number of bitplanes that will be produced from the one or more processed tiles is defined by a number of bits per pixel in the media frames. At 710, a linear bitstream is determined from the bitplanes. In at least some embodiments, this is performed by traversing a two-dimensional array of the bitplanes in a serpentine path. In other embodiments, this is performed by traversing the two-dimensional array of bitplanes in a diagonal path. At a compressed media bitstream is determined based on run-length encoding of the linear bitstream. In at least some embodiments, run-length encoding of the extracted linear bitstream comprises identifying repeat runs of bits and removing the repeat runs of bits from the compressed media bitstream. At 714, the compressed media bitstream produced from the run-length encoding is output. In at least some embodiments, outputting the compressed media bitstream includes writing the compressed media bitstream to memory.

Figure 8:
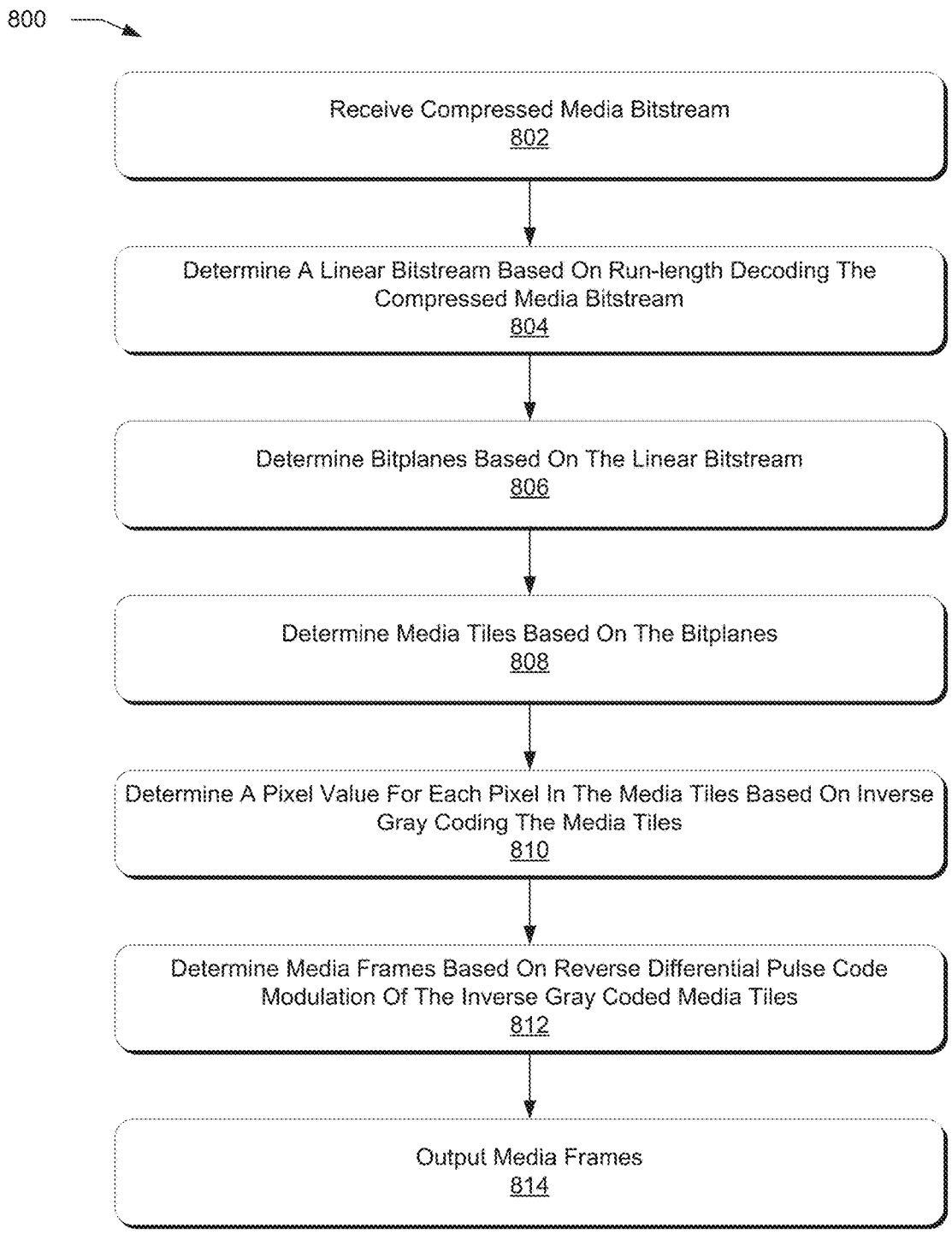
FIG. 8 is a flow diagram that describes steps in a method in accordance with one or more embodiments.

FIG. 8 illustrates a flow diagram that describes steps in a decompression method 800 in accordance with one or more embodiments. The method can be implemented in connection with any suitable hardware, software, firmware, or combination thereof. In the illustrated and described embodiment, the method 800 can be implemented by a suitably-configured run-length media decompression system, such as run-length media decompression system 200 as illustrated in FIG. 2.

At 802, a compressed media bitstream is received. In at least some embodiments, receiving a compressed media bitstream includes reading the compressed media bitstream from memory. At 804, a linear bitstream is determined based on run-length decoding the compressed media bitstream. In at least some embodiments, applying run-length decoding is performed by copying literal runs of bits from the compressed media bitstream to a decompressed media bitstream during decoding and inserting repeat runs of bits into the decompressed media bitstream during decoding. At 806, bitplanes are determined based on the decompressed linear bitstream. In at least some embodiments, bitplanes are determined by traversing a two-dimensional array of the bitplanes in a path that is a reverse of a path used to create the compressed media bitstream. At 808, media tiles are determined based on the bitplanes. In at least some embodiments, these media tiles are determined by identifying binary integer values for a pixel value from corresponding pixel locations in the bitplanes and aggregating these identified binary integer values into a pixel value for each pixel represented by the bitplanes. At 810, a pixel value for each pixel in the media tiles is determined based on inverse gray coding the media tiles. In at least some embodiments, this inverse gray coding recovers original pixel values from the gray coded pixel values. At 812, one or more media frames are determined based on reverse DPCM of the inverse gray coded media tiles. In at least some embodiments, the one or more media frames are determined by recreating original pixel values using DPCM data associated with the compressed media bitstream. Recreating original pixel values from DPCM data restores magnitudes of pixel values to their original values that existed prior to compression. At 814, decompressed media frames are output. In at least some embodiments, outputting decompressed media frames includes organizing one or more media frames from one or more media tiles.

The above-described techniques and embodiments can be implemented to reduce memory bandwidth usage associated with reading media data from memory and writing media data to memory.

Figure 9:
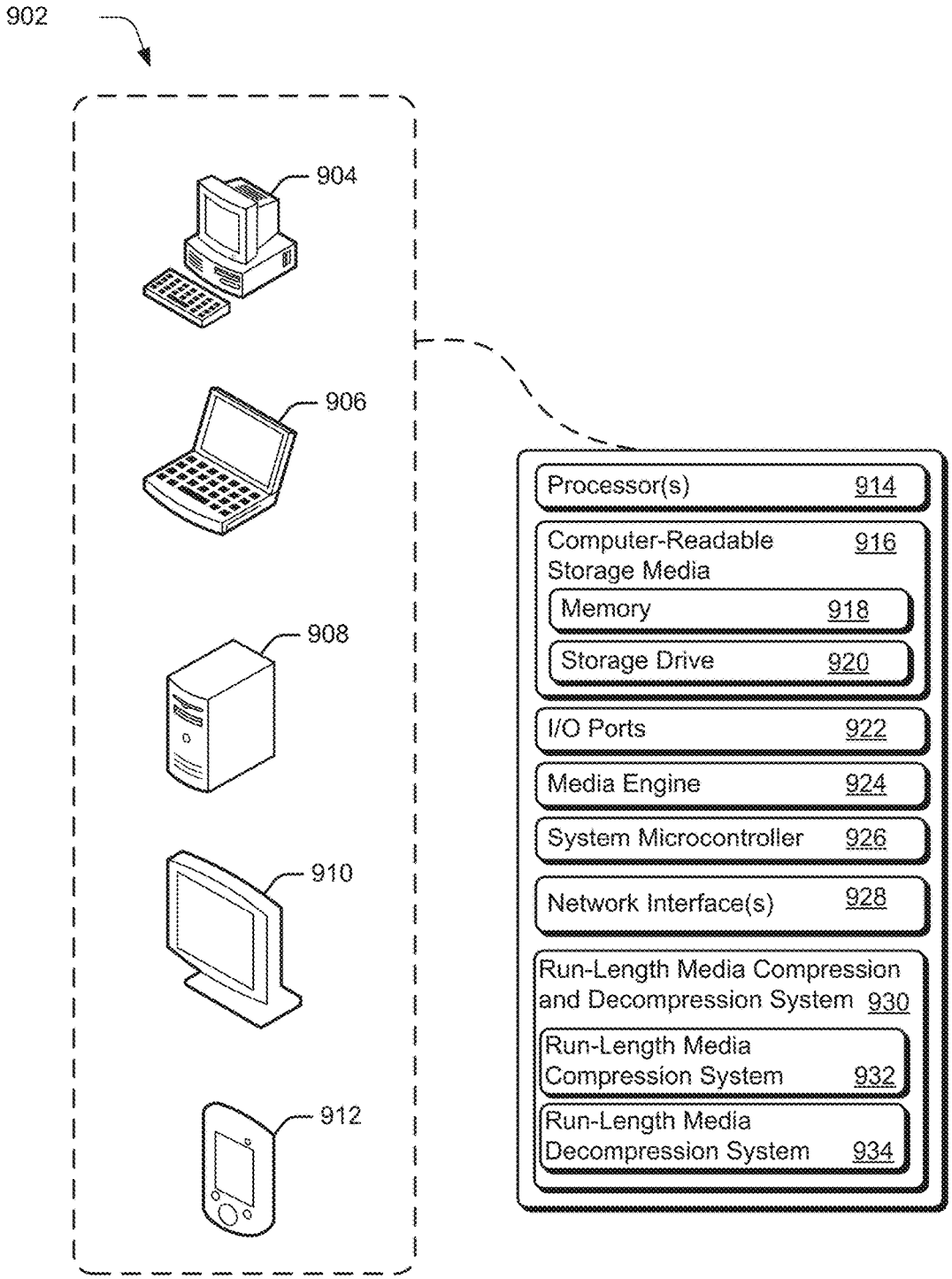
FIG. 9 illustrates an example operating environment in accordance with one or more embodiments.

FIG. 9 illustrates an example operating environment in accordance with one or more embodiments. The environment can include multiple types of devices 902 that can use the inventive principles described herein.

Devices 902 can include one or more of desktop computer 904, laptop computer 906, server 908, television 910, a set top box communicatively coupled with television 910, mobile computing device 912, as well as a variety of other devices.

Each device 902 includes processor(s) 914 and computer-readable storage media 916. Computer-readable storage media 916 may include any type and/or combination of suitable storage media, such as memory 918 and storage drive(s) 920. Memory 918 may include memory such as dynamic random-access memory (DRAM), static random access memory (SRAM), read-only memory (ROM), or Flash memory useful to store data of applications and/or an operating system of the device 902. Storage drive(s) 920 may include hard disk drives and/or solid-state drives (not shown) useful to store code or instructions associated with an operating system and/or applications of device. Processor(s) 911 can be any suitable type of processor, either single-core or multi-core, for executing instructions or commands of the operating system or applications stored on storage drivels) 920.

Devices 902 can also each include I/O ports 922, media engine 924, system microcontroller 922, network interface(s) 928, and a run-length media compression and decompression system 930 that includes or otherwise makes use of one or both of a run-length media compression system 932 or a run-length media decompression system 934 that operate as described herein. In accordance with one or more embodiments, run-length media compression system 932 may be configured as run-length media compression system 100, illustrated in FIG. 1. In accordance with one or more embodiments, run-length media decompression system 934 may be configured as run-length media decompression system 200, illustrated in FIG. 2.

I/O ports 922 allow device 902 to interact with other devices and/or users. I/O ports 922 may include any combination of internal or external ports, such as audio inputs and outputs, USB ports, Serial ATA (SATA) ports, PCI-express based ports or card-slots, and/or other legacy ports. I/O ports 922 may also include or be associated with a packet-based interface, such as a USB host controller, digital audio processor, or SATA host controller. Various peripherals may be operatively coupled with I/O ports 922, such as human-input devices (HIDs), external computer-readable storage media, or other peripherals.

Figure 10:
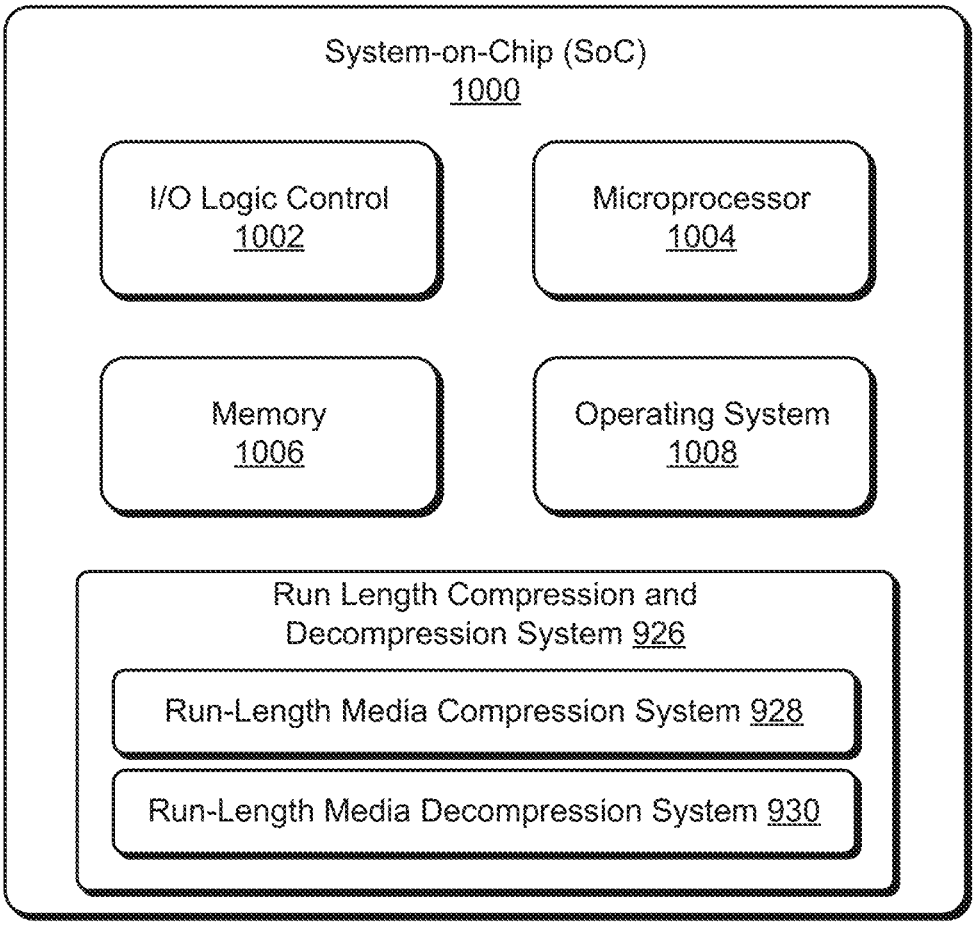
FIG. 10 illustrates a System-on-Chip SoC) environment for implementing aspects of the techniques described herein.

Media engine 924 processes and renders media for device 902, including user interface elements of an operating system, applications, command interface, or system administration interface. System microcontroller 926 manages low-level system functions of device 902. Low-level system functions may include power status and control, system clocking, basic input/output system (BIOS) functions, switch input (e.g. keyboard and button), sensor input, system status/health, and other various system "housekeeping" functions. Network interface(s) 928 provides connectivity to one or more networks FIG. 10 illustrates a System-on-Chip (SoC) 1000, which can implement various embodiments described above. The SoC 1000 can be implemented in a suitable media content processing device, such as a video processing device or graphics processing device.

The SoC 1000 can be integrated with electronic circuitry, microprocessor, memory, input-output (I/O) logic control, communication interfaces and components, other hardware, firmware, and/or software needed to provide communicate coupling for a device, such as any of the above-listed devices. The SoC 1000 can also include an integrated data bus (not shown) that couples the various components of the SoC for data communication between the components. A wireless communication device that includes the SoC 1000 can also be implemented with many combinations of differing components. In some cases, these differing components may be configured to implement concepts described herein over a wireless connection or interface.

In this example, SoC 1000 includes various components such as an input-output (I/O) logic control 1002 (e.g., to include electronic circuitry) and a microprocessor 1004 (e.g., any of a microcontroller or digital signal processor). SoC 1000 also includes a memory 1006, which can be any type of RAM, SRAM, low-latency nonvolatile memory (e.g., flashmemory), ROM, and/or other suitable electronic data storage. SoC 1000 can also include various firmware and/or software, such as an operating system 1008, which can be computer-executable instructions maintained by memory 1006 and executed by microprocessor 1004. SoC 1000 can also include other various communication interfaces and components, communication components, other hardware, firmware, and/or software.

SoC 1000 includes a run-length media compression and decompression system 930 that includes or otherwise makes use of one or both of a run-length media compression system 932 or a run-length media decompression system 934 that operate as described herein.

A tile-based run-length compression and decompression system is described that reduces memory bandwidth when encoding media data to memory and decoding media data from memory. The described run-length compression system and techniques implement a series of processing steps followed by run-length encoding to compress one or more media frames into a plurality of compressed bits in the form of a run-length encoded bitstream. The described run-length decompression system and techniques implement run-length decoding followed by a series of processing steps to decompress a compressed run-length encoded bitstream into one or more media frames. In various implementations, processing steps applied by run-length compression and decompression systems include one or more of Differential Pulse Code Modulation steps, gray coding steps, bitplane decomposition steps, pixel assembly steps, bitstream extraction steps, or bitplane organization steps. The processing steps, run-length encoding, and run-length decoding techniques discussed herein increase system compression ratios and reduce memory bandwidth usage for a system implementing the techniques when reading media data from, or writing media data to, system memory.

Although the subject matter has been described in language specific to structural features and/or methodological operations, it is to be understood that the subject matter defined in the appended claims is not necessarily limited to the specific features or operations described above, including orders in which they are performed.

What is claimed is:

1. A run-length media decompression system comprising:

a processor configured to execute instructions;

a run-length decoding module that is executable by the processor and configured to determine a linear bitstream based on run-length decoding of an input media bitstream;

a bitplane organizer module that is executable by the processor and configured to determine a plurality of bitplanes based on the linear bitstream;

a pixel assembly module that is executable by the processor and configured to generate a gray-coded pixel value for each pixel in one or more media tiles by combining a bit value from a location corresponding to a respective pixel from each of the plurality of bitplanes;

an inverse gray coding module that is executable by the processor and configured to determine a non-gray-coded pixel value from the gray-coded pixel value for each pixel in the one or more media tiles based on inverse gray coding the one or more media tiles;

a reverse differential pulse code modulation module that is executable by the processor and configured to:

determine an original pixel value magnitude from the non-gray-coded pixel value for each pixel in the one or more media tiles based on reverse differential pulse code modulation;

determine one or more media frames based on the original pixel value magnitude for each pixel in the one or more media tiles; and output the one or more media frames.

2. The system of claim 1, wherein the run-length decoding module is configured to determine the linear bitstream based on run-length decoding of the input media bitstream by:

determining one or more literal runs of bits in the input media bitstream;

determining one or more repeat runs of bits included in the linear bitstream based on one or more indications in the input media bitstream; and inserting the one or more literal runs of bits and the one or more repeat runs of bits into the linear bitstream, wherein a number of bits in the linear bitstream is greater that a number of bits in the input media bitstream.

3. The system of claim 1, wherein inverse gray coding the one or more media tiles is performed using one of $k^{th}$ order Exp-Golomb coding or a static Huffman table.

4. The system of claim 1, wherein a number of the plurality of bitplanes that are determined from the linear bitstream corresponds to a number of bits per pixel in the one or more media frames.

5. The system of claim 1, wherein the one or more media frames correspond to YUV media format and wherein the plurality of bitplanes include a plurality of luminance bitplanes for the one or more media frames and a plurality of chrominance bitplanes for the one or more media frames.

6. The system of claim 1, wherein the run-length decoding module is configured to obtain the linear bitstream by reading the linear bitstream from computing device memory.

7. A method comprising:

determining a linear bitstream based on run-length decoding of the input media bitstream;

determining a plurality of bitplanes based on the linear bitstream;

generating a gray-coded pixel value for each pixel in one or more media tiles by combining a bit value from a location corresponding to the respective pixel from each of the plurality of bitplanes;

determining a non-gray-coded pixel value from the gray-coded pixel value for each pixel in the one or more media tiles based on inverse gray coding the one or more media tiles;

determining an original pixel value magnitude from the non-gray-coded pixel value for each pixel in the one or more media tiles based on reverse differential pulse code modulation;

determining one or more media frames based on the original pixel value magnitude for each pixel in the one or more media tiles; and outputting the one or more media frames.

8. The method of claim 7, further comprising determining the linear bitstream based on run-length decoding of the input media bitstream by:

determining one or more literal runs of bits in the input media bitstream;

determining one or more repeat runs of bits included in the linear bitstream based on one or more indications in the input media bitstream; and inserting the one or more literal runs of bits and the one or more repeat runs of bits into the linear bitstream, wherein a number of bits in the linear bitstream is greater that a number of bits in the input media bitstream.

9. The method of claim 7, wherein inverse gray coding the one or more media tiles is performed using one of $k^{th}$ order Exp-Golomb coding or a static Huffman table.

10. The method of claim 7, wherein a number of the plurality of bitplanes that are determined from the linear bitstream corresponds to a number of bits per pixel in the one or more media frames.

11. The method of claim 7, wherein the one or more media frames correspond to YUV media format and wherein the plurality of bitplanes include a plurality of luminance bitplanes for the one or more media frames and a plurality of chrominance bitplanes for the one or more media frames.

12. The method of claim 7, wherein the one or more media frames correspond to RGB media format and wherein the plurality of bitplanes include a plurality of RGB bitplanes for the one or more media frames.

13. The method of claim 7, wherein the one or more media frames comprise a subset of a plurality of media frames of media content.

14. The method of claim 7, further comprising obtaining the linear bitstream by reading the linear bitstream from computing device memory.

15. A hardware-based computer-readable storage media storing processor-executable instructions that, responsive to execution by a processor of a computing device, implement operations comprising:

determining a linear bitstream based on run-length decoding of the input media bitstream;

determining a plurality of bitplanes based on the linear bitstream;

generating a gray-coded pixel value for each pixel in one or more media tiles by combining a bit value from a location corresponding to the respective pixel from each of the plurality of bitplanes;

determining a non-gray-coded pixel value from the gray-coded pixel value for each pixel in the one or more media tiles based on inverse gray coding the one or more media tiles;

determining an original pixel value magnitude from the non-gray-coded pixel value for each pixel in the one or more media tiles based on reverse differential pulse code modulation;

determining one or more media frames based on the original pixel value magnitude for each pixel in the one or more media tiles; and outputting the one or more media frames.

16. The hardware-based computer-readable storage media as recited in claim 15, wherein the operations further comprise:

determining one or more literal runs of bits in the input media bitstream;

determining one or more repeat runs of bits included in the linear bitstream based on one or more indications in the input media bitstream; and inserting the one or more literal runs of bits and the one or more repeat runs of bits into the linear bitstream, wherein a number of bits in the linear bitstream is greater that a number of bits in the input media bitstream.

17. The hardware-based computer-readable storage media as recited in claim 15, wherein inverse gray coding the one or more media tiles is performed using one of $k^{th}$ order Exp-Golomb coding or a static Huffman table.

18. The hardware-based computer-readable storage media as recited in claim 15, wherein a number of the plurality of bitplanes that are determined from the linear bitstream corresponds to a number of bits per pixel in the one or more media frames.

19. The hardware-based computer-readable storage media as recited in claim 15, wherein the one or more media frames correspond to YUV media format and wherein the plurality of bitplanes include a plurality of luminance bitplanes for the one or more media frames and a plurality of chrominance bitplanes for the one or more media frames.

20. The hardware-based computer-readable storage media as recited in claim 15, wherein the operations further comprise obtaining the linear bitstream by reading the linear bitstream from computing device memory.

* * * * *